US006594577B2

(12) United States Patent
Nakajima et al.

(10) Patent No.: US 6,594,577 B2
(45) Date of Patent: Jul. 15, 2003

(54) TRAVELING SUPPORT INFORMATION PROCESSING SYSTEM

(75) Inventors: Norihiro Nakajima, Hitachi (JP); Kazunori Takahashi, Hitachi (JP); Ryo Yumiba, Hitachi (JP); Takeshi Shima, Hitachi (JP)

(73) Assignee: National Institute For Land and Infrastructure Management, Ministry of Land, Infrastructure and Transport, Tsukuba (JP)

( * ) Notice: Subject to any disclaimer, the term of this patent is extended or adjusted under 35 U.S.C. 154(b) by 0 days.

(21) Appl. No.: 10/029,106

(22) Filed: Dec. 20, 2001

(65) Prior Publication Data

US 2002/0123838 A1 Sep. 5, 2002

(30) Foreign Application Priority Data

Mar. 5, 2001 (JP) ..... 2001-060312

(51) Int. Cl.[7] ..... G08G 1/09

(52) U.S. Cl. ..... 701/117; 701/1; 340/905; 340/910; 340/917; 342/106; 342/113; 342/114

(58) Field of Search ..... 701/117, 118, 701/119, 1; 340/905, 901, 902, 991, 910, 917; 342/106, 113, 114

(56) References Cited

U.S. PATENT DOCUMENTS 6,014,569 A * 1/2000 Bottum ..... 455/466
6,097,313 A * 8/2000 Takahashi et al. ..... 340/905
6,151,550 A * 11/2000 Nakatani ..... 701/117

* cited by examiner

*Primary Examiner*—Thomas G. Black
*Assistant Examiner*—Tuan C. To
(74) *Attorney, Agent, or Firm*—Flynn, Thiel, Boutell & Tanis, P.C.

(57) ABSTRACT

A traveling support information processing unit which can prevent willful assessment of information by a device installed on a road or loaded in a vehicle and makes it possible for the device to always issue a demand for acquisition of required information or a demand for consultation for cooperated determination, and which does not require any specific and additional device for acquisition of positional information for each vehicle and also can improve safety and efficiency in road utilization. In a computer system, vehicles 114A to 114C, 115C, and 115D with the behaviors on a road such as acceleration, deceleration, and lane change projected are made to run on a road 113 simulating the road structure. Communication is performed between a function 101 for tracking or projecting behaviors of the vehicle and the vehicles 115A, 115B having a communicating function.

5 Claims, 2 Drawing Sheets

TRAVELING SUPPORT INFORMATION PROCESSING SYSTEM

FIELD OF THE INVENTION

The present invention is directed to a traveling support information processing system which detects movement of vehicles running on a road such as acceleration, deceleration, and lane change with a computer, prepares information concerning utilization of the road by adding such road information as a road width, slope, and lane configuration to the detected data, and provides the information to the vehicles running on the road.

BACKGROUND OF THE INVENTION

As the technology for projecting or simulating movement of vehicles on a road traffic system with a computer, there are, for instance, the "PARAMICS" (Gordon Cameron, Brian J. N. Wylie, David McArthur, "PARAMICS-Moving Vehicles on the Connection Machine", IEEE 1994") in England, "SmartPATH"(Farokh Eskafi, Delnaz Khorramabadi, Pravin Varaiya, "SmartPATH: An Automated Highway System Simulator", PATH TECHNICAL MEMORANDUM 92-3, Oct. 23, 1992") in the United States, and "SOUND" (Masao Kuwabara, "Wide area network simulation", Automobile Technology No. 152, No. 1, 1998) in Japan.

All of these technologies for projecting or simulating movement of vehicles on a road traffic system with computers are related to systems which simulate or project data concerning a road network, behaviors of vehicles, road infrastructure such as traffic signals, and options made by car drivers such as lane selection, outputs a result of calculation concerning movement of vehicles, traffic density, and the like to assess the situation on the road traffic system. On the other hand, the traffic information delivery systems as represented by the VICS provided by Road Traffic Information Communication Center Foundation, (www.vics. or. jp) are systems which collect information from sensors and deliver projected information concerning occurrence of traffic jams or the like unilaterally to users of a road traffic system, and the systems are currently used.

By the way, currently a road traffic system is utilized by car drivers, and each of the drivers drive a car by projecting behaviors of other car drivers depending on his or her experience, information on utilization of a road on which the driver is now running, and following traffic rules. During these operations, when an error occurs in determination by each car driver or any car driver has a strong will to follow the driver's determination, a traffic accident or a traffic jam occurs. For a view point of smooth utilization of a road traffic system, to improve safety and smoothness in a traffic flow on the road traffic system, it is necessary to eliminate errors made by car drivers in determination of a situation on the traffic system. To satisfy this requirement, it is necessary for a number of car drivers running on a road traffic system to be capable of sharing information concerning situations on the road traffic system so that each car driver can determine how other car drivers behave, and when this requirement is satisfied, car drivers can make more accurate determination of situations on a road traffic system as compared to a case where car drivers have only a small volume of data concerning traffic situations. In the traveling support information processing system for smooth utilization of a road traffic system as described above, however, the freedom of each car driver must be esteemed, and therefore it has been impossible to restrict each individual's freedom or to make it possible for many car drivers to consult with each other so that many driver's freedom is esteemed as much as possible and at the same time safety and smoothness in road utilization are improved. Namely in the conventional technology, it has been impossible for an on-road system or an on-vehicle system to assess delivered information, nor for car drivers to request delivery of required information according to their necessity or to request consultation between car drivers. Further a specific device is required to acquire data on a current position of each vehicle, which disadvantageously results in increase of cost.

OBJECT AND SUMMARY OF THE INVENTION

The traveling support information processing system according to the present invention comprises (1) a radio communication means for interactive communications, (2) a means for receiving specification of particular vehicles from among a plurality of cars with which communication is possible, (3) a means for collecting information from the specified vehicles, (4) a means for outputting information to the specified vehicles, (5) a means for preparing information concerning utilization of a road traffic system, (6) a means for enabling consultation for assessment of behaviors of the vehicles with which communication can be performed between the information processing system installed on a road and that loaded in vehicles at least once, and (7) a means for determination of behaviors of vehicles in the future. These means function as described below and can improve safety and efficiency in road utilization.

Namely the radio communication means (1) for interactive communication which is a first means enables communications between an on-road system and devices loaded in vehicles or among vehicles, and the means only deliver information. The means (2) for receiving specification of particular vehicles from among a plurality of cars with which communication is possible, which is a second means, makes specification for all types of processing in all of the vehicles which can communicate with, for instance, the first means from the means (3) for collecting information from the specified vehicles, which is a third means, installed on a road or in vehicles or on both the road and in the vehicles. In this step, vehicles specified by different cars as an object for processing may be different, but there is no difference in the method of solving the problem with the means constituting the information processing system. When the object for processing is decided by the second means, the third means collects information from each of the vehicles, each being specified as an object, for processing. It is possible that contents of information delivered from different cars via the first means may vary from car to car, but collected information is information concerning behaviors of vehicles such as acceleration, deceleration, and lane change and a will and an aim of each car driver, namely information of destination of each vehicle.

Then, when information is collected by the third means from the running vehicles, the means (5) for preparing information concerning utilization of a road traffic system, which is a fifth means, performs projection on behaviors or traveling plans of the vehicles specified as an object for processing, and project how the road is utilized by the vehicles specified as an object for processing. The means (4) for outputting information to specified vehicles, which is a fourth means, sends the information projected by the fifth means to the vehicles specified as an object for processing. Then, the means (6) for enabling consultation for assessment of behaviors of the vehicles with which communication can be performed between the information processing system installed on a road and that loaded in vehicles at least once, which is a sixth means, determine whether the information collected by the fifth means is correct or not, and finally the means (7) for determination of behaviors of vehicles in the future, which is a seventh means, determines a plan for actions in the future with either an on-road or an in-vehicle information processing unit, and make the vehicles run according to the action plan. With the system as described above, information on action plans of other vehicles can be notified to each driver, and behaviors of vehicles dependent on the experience of and projections by inexperienced car drivers can be changed to behaviors of vehicles which can contribute to improved safety and efficiency in road utilization. As described above, it is an object of the present invention to provide a traveling support information processing system comprising information processing units provided on a road and in vehicles, which enables not only exchange of information between the information processing units, but also improvement of safety and efficiency in road utilization by exchanging information for more effective utilization of information.

DETAILED DESCRIPTION OF THE PREFERRED EMBODIMENTS

Figure 1:
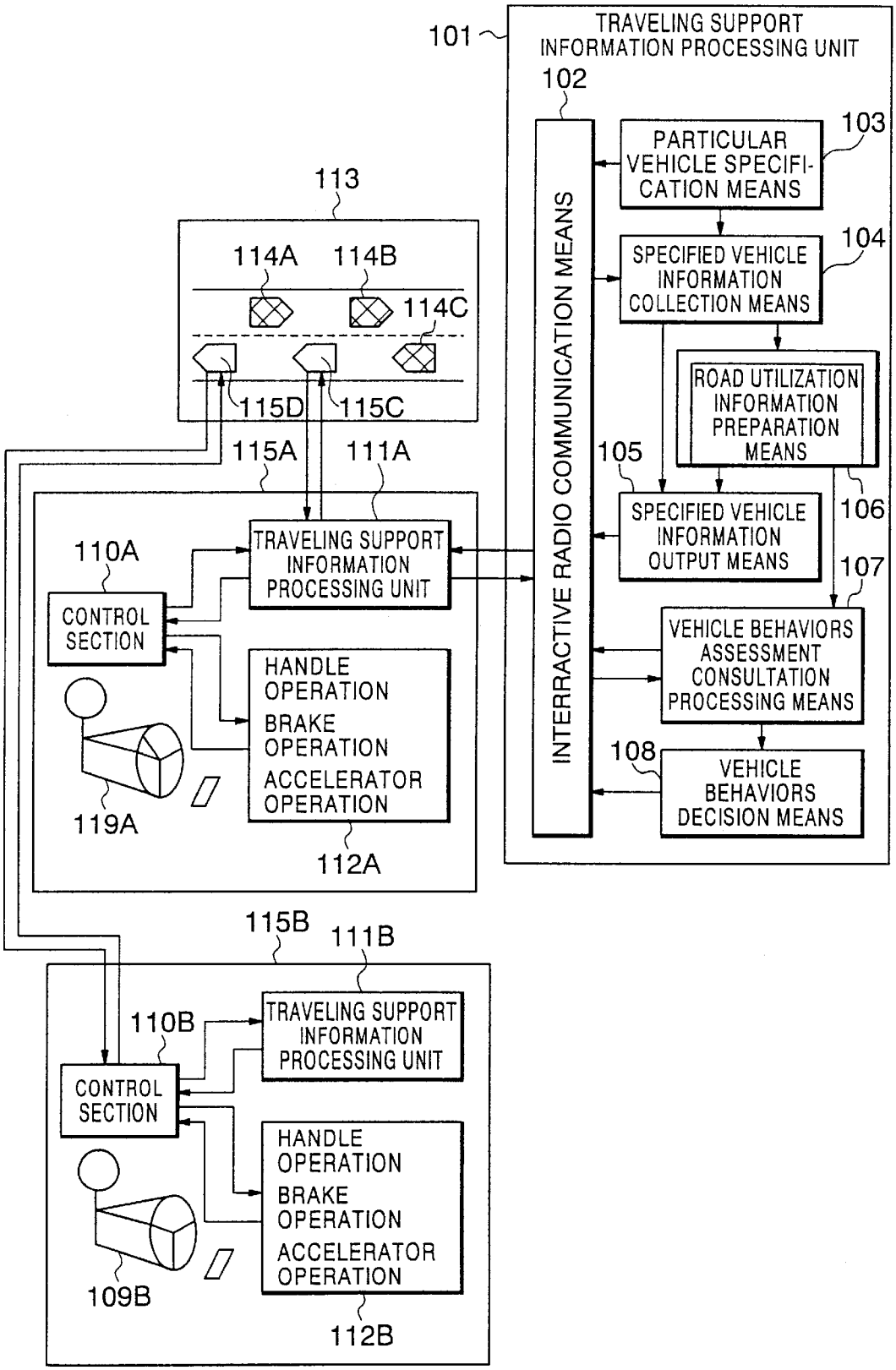
FIG. 1 is a general block diagram showing general configuration of a traveling support information processing system according to the present invention.

Embodiments of the present invention are described below. General configuration of the present invention is described below with reference to FIG. 1. The present invention comprises traveling support information units 101, 111A, and 111B, and each of the traveling support information processing units 101, 111A, and 111B comprises seven functions, namely an interactive radio communication function 102, a function 103 for specifying particular vehicles, a function 104 for collecting information from specified vehicles, a function 105 for outputting information to specified vehicles, a function 106 for providing information concerning road utilization, a function 107 for enabling consultation for assessment of vehicles' behaviors, and a function 108 for deciding vehicles' behaviors. The traveling support information processing systems 101, 111A, and 111B collect information from vehicles 115C, 115D, 114A, 114B, and 114C running on an actual road 113, and delivers information for improvement of safety and efficiency in road utilization to, for instance, the vehicle 115C running on the road with the interactive radio communication function 102 by exchanging information with the traveling support information processing units 101, 111A, and 111B.

In a first example of the traveling support information processing system according to the present invention, the traveling support information unit 101 installed on a road takes an initiative for controlling the entire system. In the first example, the traveling support information unit 101 installed on a road communicates via the interactive radio communication function 102 with the vehicles 115C, 115D, 114A, 114B, and 114C actually running on a road 113, specifies the two vehicles for example 115C and 115D from among the vehicles 115C, 115D, 114A, 114B, and 114C actually running on the road 113, and allows only the specified vehicles to communicate with the information processing unit. Then, or at the same time, the function 104 for collecting information from the specified vehicles operates to ask the specified vehicles 115C and 115D to send specified types of information via the interactive radio communication function 102. Each of the internal configurations 116A and 116B of the vehicles 115C and 115D respectively comprises a control section 110A, 110B, traveling support information processing unit loaded in the respective vehicle 111A, 111B, and units 112A, 112B for controlling behaviors of the vehicles respectively. In response to a request from the traveling support information processing unit 101 installed on a road provided as output via the function 105 for outputting information to specified vehicles by the function 104 for collecting information from the specified vehicles, the traveling support information processing units 111A, 111B determines whether to respond to the request or not, and, when it is determined to respond to the request, transmit information concerning behaviors of the car such as a destination, a speed, an acceleration or deceleration velocity, and lane selection to the traveling support information processing unit 101 on the road by following a prespecified standard for response.

The traveling support information processing unit 101 on the road receives contents of the transmitted response via the interactive radio communication function 102 and delivers the information to the function 106 for providing information concerning road utilization. The function 106 for providing information concerning road utilization prepares a running plan and projection information for each of the vehicles 115C, 115D discretely based on the delivered information, and delivers the running plan or projection information via the interactive radio communication function 102 to the traveling support information processing units 111A, 111B. When the traveling support information processing units 111A, 111B receives the running plan or projection information, the function 107 for enabling consultation for assessment of vehicles' behaviors works to operate the function 115 for deciding acceptability of the plan or projection information for a vehicle, for instance, the vehicle 115C with the traveling support information processing unit loaded in the vehicle 115C by referring the information from the traveling support information processing units 101, 111B and based on determination criteria for safety and efficiency in road utilization. In this step, when the plans and projection information prepared by the traveling support information processing units 101, 111A, 111B are different from each other, or when the traveling support information processing units 111A, 111B make, based on the information delivered to the drivers 109A, 109B, determinations different from that made by the traveling support information processing unit 101, 111A, 111B, the processing for matching the plans or projection information is made at least once among the traveling support information processing units 101, 111A, 111B via the interactive radio communication function 102.

In a second example of the present invention in which the traveling support information processing unit 111A takes an initiative for controlling the entire traveling support information processing system, the traveling support information processing unit 111A loaded in the vehicle executes the functions performed by the traveling support information processing unit 101 in Example 1. Further in a third example of the present invention, of the vehicles running on the road, 115C and 115D for example, if the vehicle 115D demands delivery of information in Example 1, the function 106 for providing information concerning road utilization works so that contents of the demand is preferentially processed, and the function 104 for collecting information from specified vehicles demand the running vehicle 115D delivery of required information according to the necessity. Further the function 107 for enabling consultation for assessment of vehicles' behaviors prepares a plan or projection information for the running vehicle 115D in response to the demand.

Figure 2:
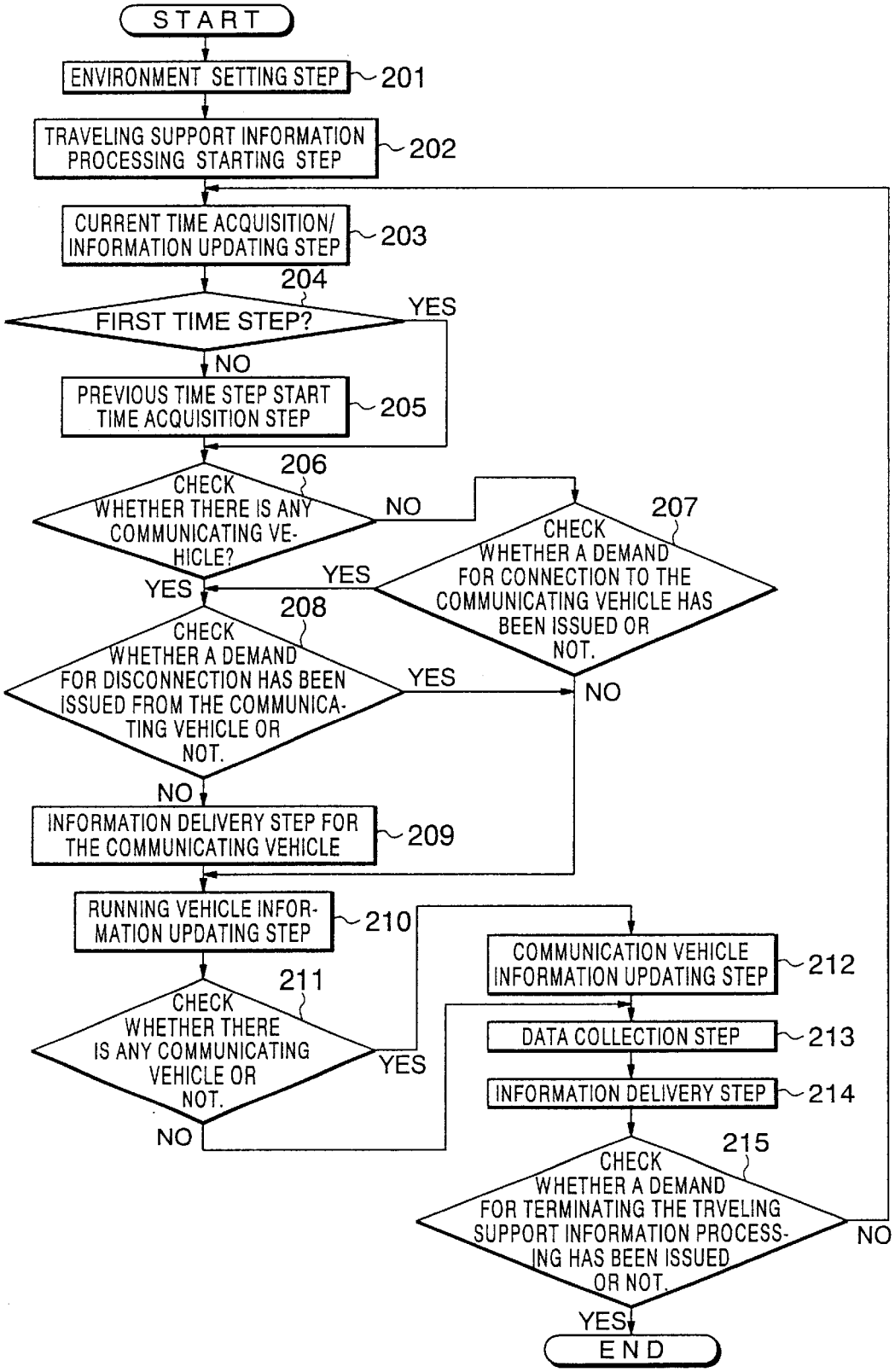
FIG. 2 is a flow chart showing details of a processing sequence performed in the traveling support information processing system.

Outline of specific processing performed in the traveling support information processing system is described below with reference to FIG. 2. Generally the traveling support information processing comprises an environment setting step 201, a traveling support information processing start step 202, a current time acquisition/information updating step 203, a branching step 204 as to whether the step is a first time step or not, a previous time step start time acquisition step 205, a branching step 206 whether communication with any vehicle is possible or not, a branching step 207 as to whether a demand for connection to a vehicle with which communication is possible, a branching step 208 as to whether a demand for disconnection from the communicating vehicle has been issued or not, information delivery step 209 for delivering information to the communication vehicle, running vehicle information updating step 210, a branching step 211 as to whether there is any communicating vehicle or not, a communicating vehicle information updating step 212, data collection step 213, an information delivery step 214, and a branching step 215 as to whether a demand for terminating the traveling support information processing has been issued or not, and the traveling support information processing is realized with the functional flow as described below.

Namely, in the traveling support information processing, the environment setting step 201 is performed previously or according to the necessity, and information concerning the current environment such as data concerning a road structure, climate, and traffic volume is acquired. Further when the traveling support information processing is started in the traveling support information processing start step 202, the current time acquisition/information updating step 203 is started, and variable data such as those on time and environmental conditions, and information required for the processing such as, for instance, information from the control center are updated. The branching step 204 as to whether the current time step is a first one or not is invoked and checked according to the necessity. When it is determined that the current time step is not a first one, the previous time step start time acquisition step 205 is invoked with the start time of the previous time step acquired, and a time difference between the previous time step and the current time step is checked. As time control is important in the traveling support information processing, whether there is any communication vehicle or not at the current point of time is determined based on this time step in the branching step 206.

On the other hand, when there is no communication vehicle, a task delivered to the branching step 207 as to whether a demand for connection to any communicating vehicle has been issued or not, and processing for connection is performed if the demand has been issued. When it is determined that there is any communicating vehicle or that a demand for connection to any communication vehicle has been issued, the branching step 208 as to whether a demand for disconnection has been issued from the communicating vehicle is performed, and when it is determined that the demand for disconnection has not been issued, the information delivery step 209 is executed to the communicating vehicle. If it is determined that a demand for disconnection has been issued from the communicating vehicle, the information delivery step 209 for the communicating vehicle is not performed. When the information delivery step 209 to the communication vehicle is finished, the running vehicle information updating step 210 is executed, and then the branching step 211 as to whether there is any other communicating vehicle or not is started. When it is determined that there is another communicating vehicle, a sequence of processing steps such as the communicating vehicle information updating step 212, data collection step 213, and information delivery step 214 is performed. In the branching step 215 as to whether a demand for terminating the traveling support information processing has been issued or not, the processing branches to a case where consultation with the new vehicle and the information delivery processing are terminated, and to a case where the processing is continued, and with the processing flow, one traveling support information processing cycle is finished. With the processing sequence as described above, traveling support information can be prepared in the traveling support information processing system, which enables safe utilization of a road by road users and improves safety in road utilization.

The present invention provides the advantages that a road user conventionally, depending on individual experience and feeling, can project behaviors of other road users by referring to information transmitted continuously from traveling support information processing units on a road or by demanding the necessary information and referring the delivered information, and that safety in road utilization is further improved.

What is claimed is:

1. A traveling support information processing system for executing interactive communication via radio with specified vehicles being driven on a road, said traveling information processing system comprising:

a first traveling support information unit provided on or near the road, said first traveling support information unit comprising particular vehicle specification means for identifying the specified vehicles, specified vehicle information collection means for collecting information from each of the specified vehicles, road utilization information preparation means for preparing information regarding road utilization from the information collected from the specified vehicles, specified vehicle information output means for outputting information regarding the specified vehicles based on the information collected from the specified vehicles and the road utilizaton information, vehicle behavior assessment consultation processing means for providing consultation and communication between the first traveling support information unit and a second traveling support information unit provided in each of the specified vehicles regarding their behavior based on the information collected from the specified vehicles and the road utilization information, and vehicle behavior decision means for determining the future behavior of vehicles based on the vehicle behavior assessment consultation processing means; and a second traveling support information unit provided in each of the specified vehicles.

2. The traveling support information processing system of claim 1, additionally comprising means for enabling radio communication between the first traveling support information unit and the second traveling support information unit.

3. The traveling support information processing system of claim 1, additionally comprising means for performing one-way communication via a radio communication device with the specified vehicles and information delivery units spaced apart at a distance of at least 10 meters from each other for receiving information regarding the operation of the specified vehicles.

4. The traveling support information processing system according to claim 1, wherein information concerning traveling of the specified vehicles is projected in relation to vehicles not having means for communicating with the traveling support information processing system and prepared from information obtained through the use of a sensor.

5. The traveling support information processing system according to claim 1, wherein information regarding the driver's operation of the vehicle is collected and is at least one member selected from the group consisting of the speed of the vehicle, the acceleration of the vehicle and the deceleration of the vehicle.

* * * * *